United States Patent [19]

Cvetkovic

[11] Patent Number: 4,827,546

[45] Date of Patent: May 9, 1989

[54] FLUID MATTRESS

[76] Inventor: Milutin Cvetkovic, 18 Jopling Ave. North, Toronto (Islington), Ontario, Canada, M9B 4E7

[21] Appl. No.: 154,067

[22] Filed: Feb. 9, 1988

[51] Int. Cl.[4] ..... A47C 27/08; A47C 27/04

[52] U.S. Cl. ..... 5/455; 5/449; 5/451; 5/475; 5/267; 297/DIG. 8

[58] Field of Search ..... 5/455, 456, 453, 449, 5/451, 475, 267; 297/DIG. 8, DIG. 3

[56] References Cited

U.S. PATENT DOCUMENTS

| | | | |
|---|---|---|---|
| 1,353,260 | 9/1920 | Monks | 5/455 |
| 2,434,641 | 1/1948 | Burns | 297/DIG. 3 |
| 2,897,520 | 8/1959 | Bradford | 5/455 |
| 3,879,776 | 4/1975 | Solen | 5/453 |
| 3,982,786 | 9/1976 | Burgin et al. | 5/453 |
| 4,120,061 | 10/1978 | Clark | 297/DIG. 8 |

*Primary Examiner*—Alexander Grosz
*Attorney, Agent, or Firm*—Moss, Hammond

[57] ABSTRACT

A fluid containing mattress including exterior support in the form of side frames and a bottom support. Flexible, contractible bellows are distributed over the bottom support and are connected thereto. Tubing connects the bellows to adjacent bellows to permit fluid flow between them. A selected amount of fluid is provided in the bellows. A top cover including a cushion extends over the bellows. Coil springs are mounted on top of the bellows and support the top cover. Elastomeric members connect each coil spring to adjacent coil springs.

19 Claims, 5 Drawing Sheets

FLUID MATTRESS

BACKGROUND OF THE INVENTION

This invention relates to fluid mattresses and, in particular, the type of fluid mattress that employs accordion-like flexible bellows.

A variety of mattresses and beds of different construction are known. Many of the well known mattress constructions have shortcomings which can cause discomfort and disruption to the sleeping process. There are at least four basic types of mattresses known to the applicant that are commonly used.

The first type of mattress has rows of coil springs that are connected to each other at the top. This mattress can cause discomfort because the top surface of the mattress has little flexibility and, as a result, protruding parts of the human body are not allowed to sink down. These protruding parts are thus subjected to considerable pressure which can cause discomfort and the need to frequently change the position of one's body. Deep sleep can be disturbed and the end result can then be an incomplete sleep.

A second known type of mattress is that employed in the well known water bed. Problems with this type of mattress are that too much water is required to fill the mattress and an electric heater is generally required to maintain the water temperature at a suitable level. Moreover, generally chemicals must be used to prevent the development of bacteria and algae. If the motion of the water in the mattress is uncontrolled or poorly controlled, the motion can cause nausea in some people. Further difficulties with this type of mattress are the difficulty of getting out of bed due to poor bottom support and inadequate spine support. This type of mattress is also not suitable for two persons of different weights. Lack of airation and positive ventilation through the bag that encloses the water also reduce comfort and can cause excessive perspiration when a person is sleeping on this type of mattress. Further, a water filled mattress does not follow the human body curvature but rather causes the ends of the body, that is the legs and the head-shoulder area, to be lifted up while the user's trunk remains low, a situation which will cause discomfort to the user.

A third type of common mattress uses foam as the sleeping surface. This type of mattress will also cause discomfort to the user because of poor ventilation and excessive body perspiration. The mattress will not follow the natural body curvature and pressure on one body part cannot be transferred to other parts nor can this pressure be minimized. The end result, again, can be an incomplete sleep or rest.

A fourth type of mattress employs coil springs but these springs are not connected to each other at the top. The same disadvantages can arise with this type of mattress as with the first type having connected coil springs. The difference is that a smaller surface area is affected by the resistance of a single spring. Resistance to pressure on a protruding body part cannot be minimized or transferred to other springs in the mattress.

It is an object of the present invention to provide a fluid containing mattress that has flexible and contractible bellows and that is very comfortable to sleep on.

It is a further object of the present invention to provide a fluid containing mattress that includes a bottom support to which the aforementioned bellows can be connected and side frames which make it easier to get off the mattress and out of bed.

SUMMARY OF THE INVENTION

According to one aspect of the invention, a fluid containing mattress comprises exterior support means including side frames and a bottom support, flexible and contractible bellows distributed over the bottom support and connected thereto, and tubing connecting the bellows to adjacent bellows to permit fluid flow between them. There is also provided a selected amount of fluid in the bellows and a top cover extending over the bellows.

Preferably, the mattress includes coil springs mounted on top of the bellows and supporting the top cover.

According to a further aspect of the invention, a fluid mattress includes a frame structure, support plates at the bottom of the mattress affixed to the frame structure and to each other, and accordion-like flexible bellows having their bottom ends fixed to the plates. Connecting tubing connects the bellows to adjacent bellows to allow fluid flow therebetween. Fluid fills the bellows as a means by which the pressure is distributed among the bellows. Coil springs are mounted on top of the bellows and elastomeric bands connect the coil springs to adjacent springs. A cover, which preferably includes a top cushion, extends over the coil springs.

In one preferred embodiment, the frame structure comprises two rectangular parts, one on the top and one on the bottom, each having two parallel adjacent running bars forming one rectangular shape inside the other.

DETAILED DESCRIPTION OF PREFERRED EMBODIMENT

Figure 1:
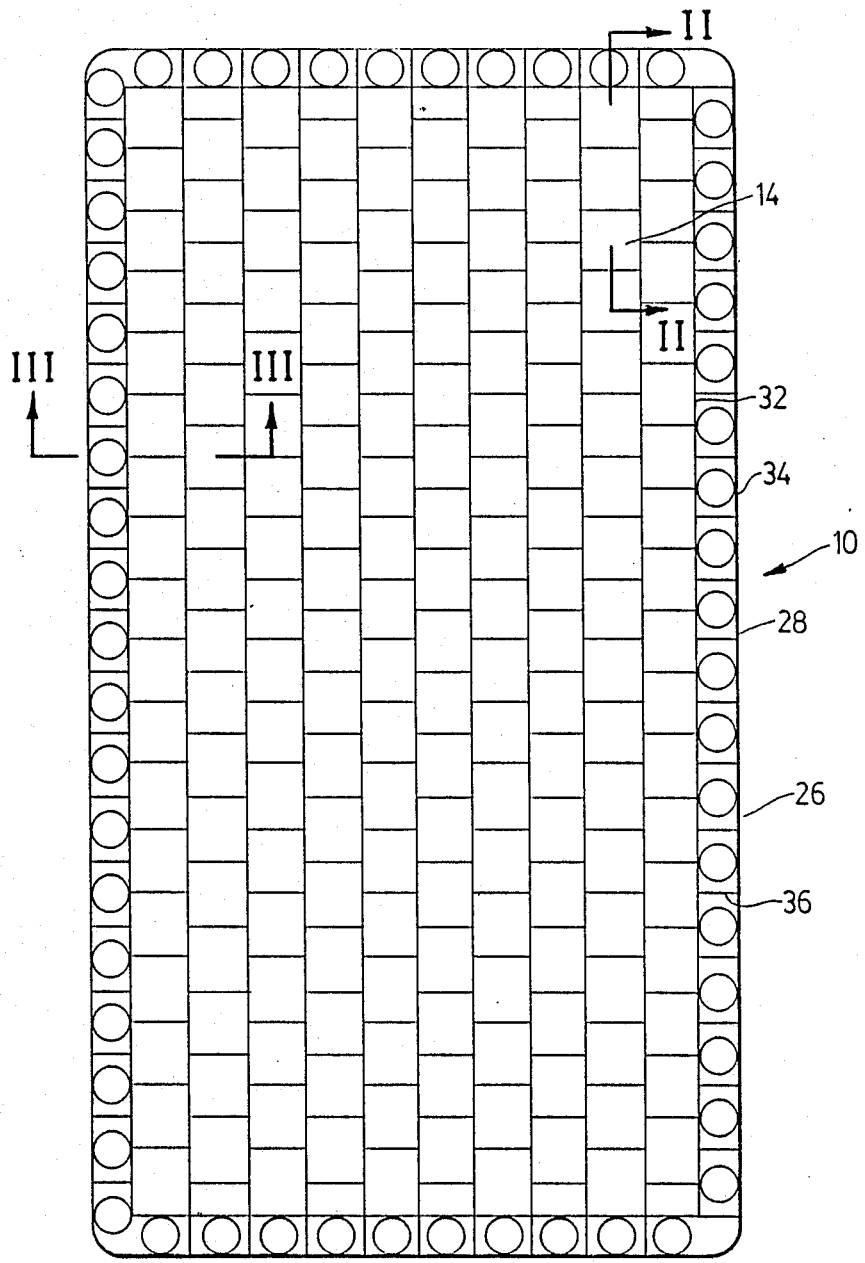
FIG. 1 is a bottom view of a fluid mattress constructed in accordance with the invention.
Figure 2:
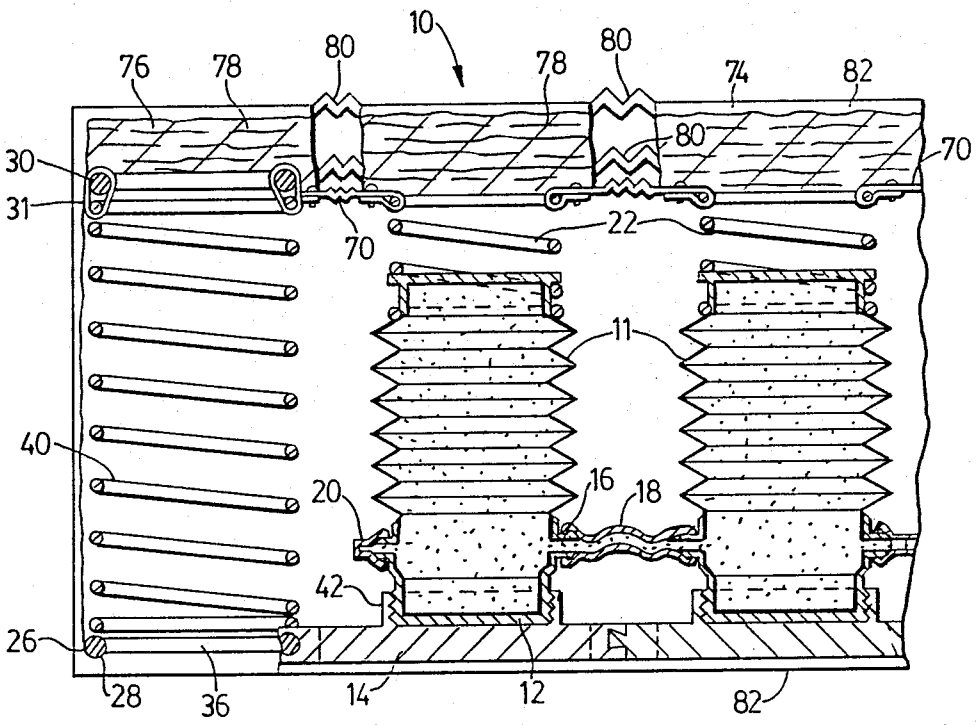
FIG. 2 is a cross-sectional elevation taken along the line II—II of FIG. 1.

In FIG. 1 there is shown the bottom of a fluid mattress 10 constructed in accordance with this invention. As illustrated in FIG. 2, this mattress includes a number of accordion-like flexible bellows 11, each of which has its bottom end 12 connected to a support plate 14. The preferred material for the bellows is an elastomeric plastics material or a suitable rubber material. A fluid such as air or water fills the bellows 11 as a means by which the pressure on the top of the mattress is distributed among the bellows. Near the bottom of each bellows are at least two outlets 16 to which connecting tubing 18 is connected as shown in FIG. 2. Thus, each bellows is connected to one or more adjacent bellows to allow fluid flow therebetween. In the case of the bellows at the edge of the mattress, the outward outlet 16 can simply be closed off by a suitable cap 20. Because the fluid can flow from one bellows to another, sections of the top surface of the mattress 10 can change their resistance to downward pressure and in this way the mattress can follow the curvature of the body lying on the top of the mattress.

Another preferred feature of the present mattress is the use of coil springs 22 which are located on top of the bellows 11 and which cause the top surface of the mattress to be well ventilated.

Figure 3:
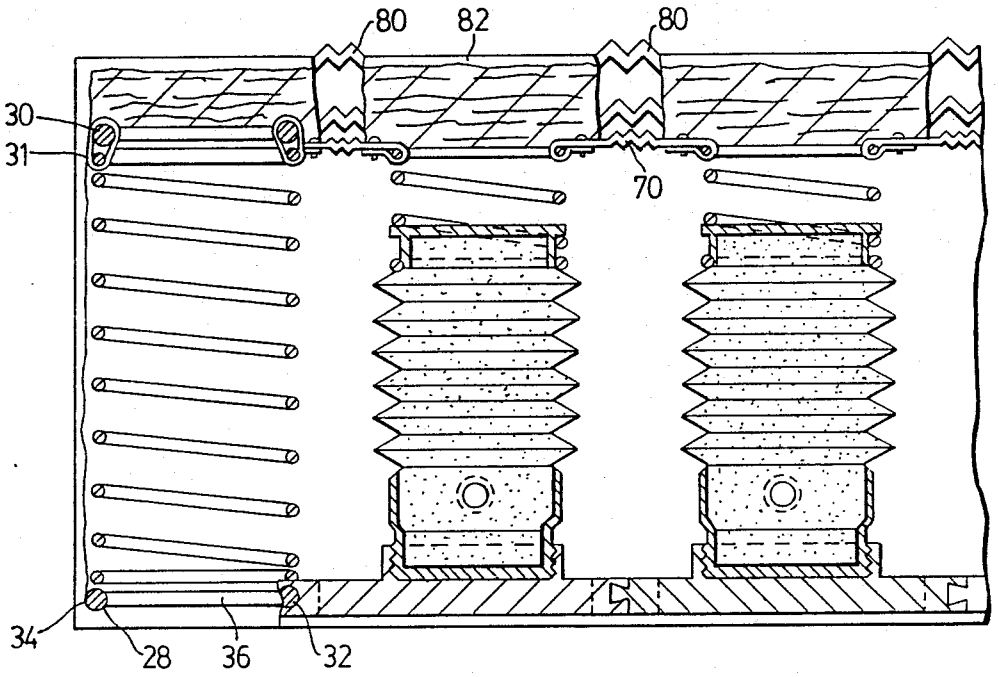
FIG. 3 is a cross-sectional elevation taken along the line III—III of FIG. 1.

The preferred embodiment of the fluid mattress shown in FIG. 1 includes a frame structure 26 that comprises a lower rectangular component 28 and a similar upper rectangular component 30. Each side of each of the upper and lower components consists of two parallel metal bars or tubing 32 and 34 so that in effect an internal rectangle and an external rectangle are formed by each component as indicated in FIG. 1. The two parallel bars or tubing on each side are connected by horizontally extending metal rungs 36 in order to form a very rigid frame structure. The lower component 28 shown in FIG. 1 is connected to the upper component 30 by means of vertically extending coil springs 40 which are illustrated in FIGS. 2 and 3. These springs are located between the two parallel bars of the upper and lower components. The springs 40 are attached to the rectangular components 28 and 30 by suitable ties or connectors 31. The complete frame structure serves as a border for the mattress and it maintains the rectangular shape of the fluid mattress. This frame structure also serves as a support for other components of the fluid mattress which are connected thereto as explained hereinafter. With the described frame structure, it is easier for a user to move off of the present fluid mattress than is the case with many waterbeds.

The supporting plates 14 will now be further described with particular reference to FIGS. 1, 2, and 5 to 8. The preferred material for these plates is a hard, strong plastics material. These plates are connected together in rows as shown in FIG. 1 to provide a flat bottom support for the fluid mattress. Each bellows 11 has its own supporting plate 14 as indicated in FIGS. 2 and 3. Each plate is formed with an internally threaded circular connector 42. The threads of this connector cooperate with threads formed on the bottom end of the bellows and this threaded engagement fixes the bottom of the bellows in place and does not permit it to shift in position. At least the internal supporting plates 14 can be constructed in the manner shown in FIGS. 5 and 6. These plates have a dovetail groove 46 formed along two sides 48 and 50 of the plate. On the other two sides 52 and 54, there is a dovetail-shaped connecting rib 60 sized to fit in the grooves 46 of the other supporting plates.

Figure 7:
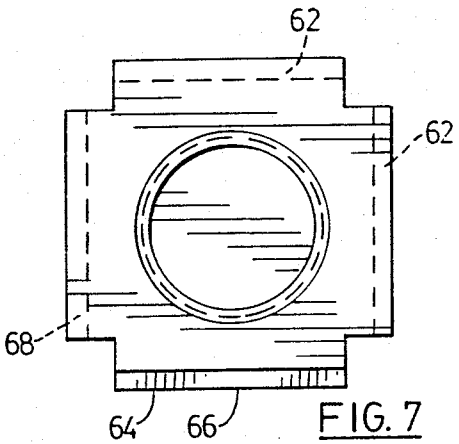
FIG. 7 is a plan view of another single support plate of different construction.
Figure 8:
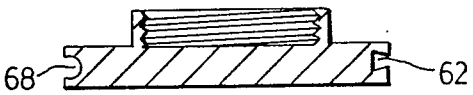
FIG. 8 is a cross-sectional elevation taken along the line VIII—VIII of FIG. 7.
Figure 5:
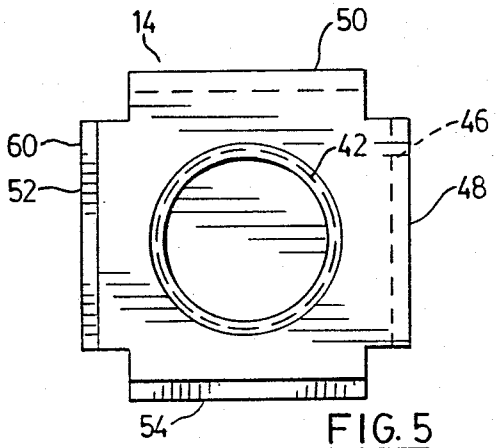
FIG. 5 is a top view of a single support plate on which a bellow is mounted.
Figure 6:
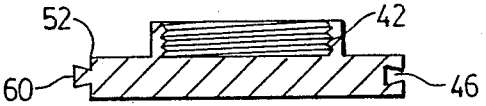
FIG. 6 is a cross-sectional elevation taken along the line VI—VI of FIG. 5.

FIGS. 7 and 8 illustrate the supporting plates that can be used along the four edges of the bottom surface of the mattress. As in the version shown in FIGS. 5 and 6, two edges of the supporting plate are provided with dovetail-shaped grooves 62. Also, along a third edge 64 of these supporting plates there is a dovetail-shaped connecting rib 66. However, along the fourth edge of the supporting plate there is a rounded connecting groove 68. As illustrated in FIGS. 2 and 3, the grooves 68 are used to attach the lower rectangular component 28 to the bottom surface formed by the plates. In particular, the rounded inner bar 32 is sized to snap into the rounded groove 68.

The aforementioned bellows 11 are lined up in rows as indicated by the arrangement of the supporting plates shown in FIG. 1. The number of bellows in each row and the number of rows is determined by the size of the mattress desired. The fluid which fills the bellows and the connecting tubing should be a neutral fluid that is harmless to humans. One such suitable fluid is air but a liquid could also be used. Once the fluid has been introduced into the bellows and tubing, any opening into the system of bellows is closed off. Thus the fluid may flow through the tubings from one bellows to another but it cannot escape from the system.

The aforementioned coil springs 22, in addition to providing ventilation, help to provide protection from injuries or discomfort if one of the bellows should suddenly malfunction. These springs follow the movements of the bellows and respond to pressure from inside the bellows or to external body pressure.

Figure 4:
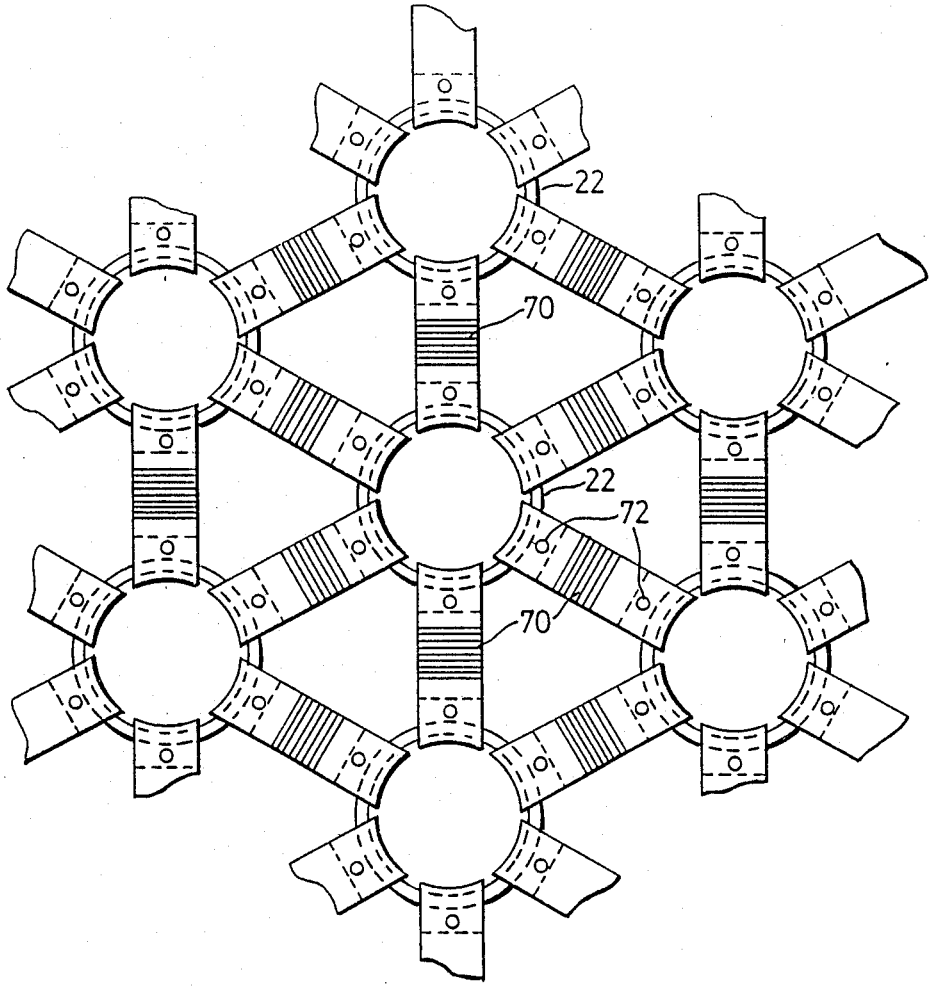
FIG. 4 is a detailed plan view illustrating the connections between the coil springs located on top of the bellows.

Preferably elastomeric bands 70 connect the coil springs 22 to adjacent springs. These bands 70 prevent each combination of bellows and spring from moving too far away from adjacent bellows-spring combinations in the horizontal direction. The bands 70 help to bring each of these combinations back to its normal position when the mattress is not in use. FIG. 4 of the drawings illustrates how each internal coil spring 22 is connected by six elastic bands 70 to six adjacent coil springs. Each elastic band 70 has its end wrapped around a top coil of the adjacent coil spring and this bent over end is secured by a rivet or other suitable fastener 72.

Another function of the elastic bands 70 is the filling of the gaps between the springs 22, thus providing additional support for a body laying on the mattress. Because of their elastic nature, these bands permit the springs to move vertically up and down with the vertical movements of the bellows.

The fluid mattress includes a cover 74 that extends over the coil springs 22. The preferred cover over the top includes a top cushion 76 made of soft cotton or cotton-like material. This relatively thick top cushion serves as an insulating pad that increases the comfort of the fluid mattress. Preferably this top cushion 76 is divided into sections 78 that are joined by further elastic bands 80. This construction for the top cushion ensures that the top cushion does not interfere with the operation of the springs 22 and the bellows connected thereto. Thus, the top cushion is able to expand and contract as necessary when a person is laying on the mattress. Thus, proper movement of the coil springs 22 up and down is not impeded by the top cushion.

The cover for this fluid mattress preferably includes a strong outer layer made of a suitable fabric. This outer layer 82 preferably covers both the bottom and the top of the mattress as well as the sides. If desired, this outer cover can be divided into a top half and a lower half which are detachably connected around the sides of the mattress, such as by a zipper (not shown). In this way, the owner of the mattress has easy access to the interior should this be necessary for any reason, such as for repairs.

To assemble the mattress of the invention, the supporting plates 14 are first attached together to form the bottom support surface. The outer supporting plates 14 that extend around the periphery of the bottom surface are then connected to the lower component 28 of the frame structure. The outer coil springs 40 are connected to the lower frame component 28 at this time. Each of the bellows 11 is then screwed onto its respective supporting plate and then each bellows is connected to one or more adjacent bellows by means of the plastic tubing 18. The coil springs 22 are then placed on their respective bellows and then these coil springs are attached to one another by the elastic bands 70 in the manner illustrated in FIG. 4. The bellows and their connecting tubes are then filled with the desired fluid and then the bellows system is closed to prevent the escape of this fluid from the system. Next, the top cushion 76 is placed on top of the springs 22 in the illustrated manner and the complete exterior of the mattress is covered with a strong fabric layer.

When assembled as described, the mattress can be used by simply placing it on a suitable foundation or support surface. No special foundation is required for the present fluid mattress. If required, the individual components of a mattress can be replaced.

It will also be appreciated that the principles of the present invention can be incorporated into the construction of seats such as wheelchair seats and car seats or sofas. For such purposes, it is simply necessary to change the size of the components that are combined to produce the seat.

From the above description of the invention, it will be appreciated that the present fluid mattress can provide maximum comfort and relaxation for sleeping or resting purposes. The present mattress is able to redistribute the pressure applied to it by the various parts of the human body. Because of this the contact pressure between the body and the mattress is equally distributed and automatically adjusts as the body moves or rolls on the mattress. Because of the adjusting characteristics of the invention, alignment of the body's joints and other parts is maintained in a natural position. The present mattress will permit undisturbed blood circulation through the soft tissue around protruding body parts and this in turn can result in a longer and deeper sleep.

Other advantages of the present fluid mattress will be readily apparent to those skilled in this art. Unlike waterbeds, the present bed does not require any kind of energy in order to be used. Although a non-harmful fluid is required for the operation of the bellows, this fluid does not have to be changed after initial introduction as long as the mattress is not damaged. The ability of the present fluid mattress to provide adequate ventilation in the region of the support surface is particularly important for people who are unable to get up, turn or move.

The combination of the various components that make up the present fluid mattress allows for three dimensional movement and this is important to achieving a comfortable mattress.

Various modifications and changes to the described fluid mattress will be apparent to those skilled in this art. Accordingly, all such modifications and changes as fall within the scope of the appended claims are intended to be part of this invention.

I claim:

1. A fluid mattress comprising:

(a) a frame structure;

(b) support plates at the bottom of said mattress fixed to the frame structure and to each other;

(c) accordion-like flexible bellows having their bottom ends fixed to the plates;

(d) connecting tubing means for connection of said bellows to adjacent bellows to allow fluid flow;

(e) fluid filling said bellows as a means by which the pressure is distributed among said bellows;

(f) connecting tubing means for connection of said bellows to adjacent bellows to allow fluid flow;

(g) coil springs mounted on top of said bellows;

(h) elastomeric bands connecting said coil springs to adjacent springs;

(i) a cover extending over the coil springs.

2. A fluid mattress as defined in claim 1 wherein said frame structure comprises two rectangular parts, one on the top, the other on the bottom, each having two parallel adjacent running bars forming one rectangular shape inside the other.

3. A fluid mattress as defined in claim 1 wherein said plates are connected to each other along interlocking edges thereof.

4. A fluid mattress as defined in claim 1 wherein said fluid is harmless to humans.

5. A fluid mattress as defined in claim 1 wherein said bellows are inflatable and made of plastics, said tubing means are made of plastics, and said bellows are arranged in rows and are adapted to support the human body.

6. A fluid mattress as defined in claim 1 wherein said connecting tubing means are made of plastics and allow said fluid to flow without obstruction from each bellow to adjacent bellows.

7. A fluid mattress as defined in claim 1 wherein said mattress has the ability to absorb pressure of protruding parts of a human body lying thereon and to transfer this pressure to concave parts of the body by fluid movement from depressed bellows to bellows that are not depressed and are situated underneath the concave parts of said body.

8. A fluid mattress as defined in claim 1 including means for changing the pressure inside the bellows so that the hardness of the mattress can be adjusted to suit different body weights.

9. A fluid mattress as defined in claim 1 wherein said mattress has sections of different hardness.

10. A fluid mattress as defined in claim 1 wherein said elastomeric bands prevent the coil springs from moving too far from each other and allow vertical movement of said bellows.

11. A fluid mattress as defined in claim 1 wherein said cover includes a top cushion divided into sections that are connected by further elastic bands which allow vertical movement of said coil springs and said bellows.

12. A fluid containing mattress comprising:

(a) exterior support means including side frames and a bottom support;

(b) flexible and contractible bellows distributed over said bottom support and connected thereto;

(c) tubing connecting said bellows to adjacent bellows to permit fluid flow between said bellows;

(d) a selected amount of fluid in said bellows;

(e) top cover means extending over said bellows and coil springs mounted on top of said bellows and supporting said top cover means.

13. A fluid containing mattress according to claim 12 including elastomeric members connecting each coil spring to adjacent coil springs.

14. A fluid containing mattress according to claim 12 wherein said top cover means includes a top cushion divided into sections that are connected by elastic bands which allow vertical movement of said coil springs and said bellows.

15. A fluid containing mattress according to claim 12 wherein said bottom support comprises rows of similar plates connected together by interlocking edges thereof, each plate having integral connecting means to attach the bottom end of a respective bellows to the plate.

16. A fluid containing mattress according to claim 12 wherein said bottom support has an upper surface with rows of threaded connectors provided thereon for the fixing of bottom ends of said bellows.

17. A fluid containing mattress according to claim 12 wherein said side frames include similar upper and lower generally rectangular frames connected together by resilient springs.

18. A fluid containing mattress comprising:

(a) exterior frame means extending along side edges of said mattress;

(b) a bottom support connected to said frame means and extending substantially the length and width of the mattress;

(c) rows of contractible bellows having their bottom ends fixed to said bottom support;

(d) tubing for connecting each bellows to its adjacent bellows for fluid flow therebetween;

(e) a fluid sealingly contained in said bellows and tubing;

(f) coil springs mounted on top of said bellows and connected thereto;

(g) stretchible elastic means for connecting each coil spring to its adjacent coil springs; and (h) top cover means, including a cushion layer, extending over said coil springs.

19. A fluid containing mattress according to claim 18 wherein said fluid is a harmless liquid.

* * * * *